United States Patent [19]

Bujese

[11] Patent Number: 4,855,784

[45] Date of Patent: Aug. 8, 1989

[54] WEB BACKING PLATE

[75] Inventor: David P. Bujese, Butler, N.J.

[73] Assignee: Olin Hunt Specialty Products Inc., Palisades Park, N.J.

[21] Appl. No.: 135,838

[22] Filed: Dec. 21, 1987

[51] Int. Cl.[4] ..... G03G 15/14; G03G 15/16

[52] U.S. Cl. ..... 355/272; 355/212

[58] Field of Search ..... 355/3 R, 3 TR, 3 TE, 355/4, 10, 14 TR

[56] References Cited

U.S. PATENT DOCUMENTS

| | | | |
|---|---|---|---|
| T869,004 | 12/1969 | Culhane | 96/1.4 |
| 3,063,351 | 11/1962 | Medley | 355/3 T |
| 3,761,174 | 9/1973 | Davidson | 355/3 R |
| 3,885,870 | 5/1975 | Levy et al. | 355/3 R |
| 3,950,095 | 4/1976 | Bouygues et al. | 355/72 |
| 4,182,266 | 1/1980 | Alston | 355/3 TR X |
| 4,217,819 | 8/1980 | von Tluck et al. | 355/3 TR X |
| 4,226,526 | 10/1980 | Spence-Bate et al. | 355/53 |
| 4,358,195 | 11/1982 | Kuehnle et al. | 355/4 |
| 4,478,924 | 10/1984 | Moraw | 430/136 |
| 4,498,758 | 2/1985 | Nelen | 355/3 TR |
| 4,556,309 | 12/1985 | Weber et al. | 355/3 TR |

*Primary Examiner*—Fred L. Braun

*Attorney, Agent, or Firm*—Ralph D'Alessandro

[57] ABSTRACT

An apparatus for the electrostatic transfer of a developed image from a master to a receiving surface, there is provided a movable backing plate for the flexible carrier support for the master. The movable backing plate supports the transfer roller during development and ensures uniform distance between the master and the charging, developing and cleaning apparatus.

32 Claims, 7 Drawing Sheets

WEB BACKING PLATE

BACKGROUND OF THE INVENTION

This invention relates generally to apparatus for the electrostatic transfer of a developed image from a master to a receiving surface. More specifically, it pertains to the carrier backing means and the cooperation with the movable transfer means that contacts and traverses the flexible carrier means which supports the master to effect the electrostatic transfer.

The permanent master and the transfer means are used repeatedly to produce high resolution and high quality images on receiving surfaces, such as printed circuit boards. Receiving surfaces, such as printed circuit boards, have traditionally been produced by individual laminating, exposing, developing, etching and stripping processes where dry film photoresist has been used to produce the conductive wiring patterns. Heretofore, there has been no method or apparatus available to produce a plurality of copies of conductive wiring patterns from a single master copy of the desired wiring pattern utilizing a dry film resist and photoimaging. There are many factors which prevented this type of a system from being employed to manufacture multiple copies from a single master.

Where liquid toner was employed, it was extremely difficult to attempt to clean excess toner or prevent the buildup of excess toner from the master. The ability to obtain a uniform and full width image over a large area, such as a 24 inch by 24 inch surface, was severely restricted. Trapped air or excess liquid solvent can frequently cause voids in the electrostatically transferred developed image. The ability to clean off residual toner from the master prior to transferring each additional electrostatically developed image is important. Where electrostatics were used to effect the transfer, the ability to separate the master surface and the receiving surface was critical and extremely difficult because of the electrostatic forces involved. Lastly, the availability of reliable and durable equipment to effect repeated transfers of the developed image on a master to a receiving surface was severely limited.

These problems are solved in the design of the apparatus of the present invention by providing carrier backing means that cooperates with the transfer means which contacts the flexible carrier of the master to provide a flat surface and to maintain a uniform distance between the master and the component parts during development of the electrostatic image and cleaning of the master. The electrostatic transfer of a developed image to a receiving substrate is effected by traversing the carrier means for a distance equal to at least the length of the master.

SUMMARY OF THE INVENTION

It is an object of the present invention to provide carrier backing means that are cooperative with the carrier means and the transfer roller means to maintain a uniform distance between the master and the charging, developing and cleaning apparatus.

It is another object of the present invention to provide a generally flat backing surface to the carrier means to ensure the master is properly cleaned.

It is a feature of the present invention that the carrier backing means cooperates with the transfer roller means as the transfer roller means traverse over the carrier web means to which the master is attached to electrostatically transfer the developed image on the master across the finite liquid filled gap to the receiving substrate.

It is another feature of the present invention that the carrier backing means cooperates with the transfer roller means to reposition the transfer roller means for subsequent image transfers.

It is yet another feature of the present invention that a flexible web can be used as the carrier means.

It is an advantage of the present invention that good transferred image resolution is obtained during the discrete point transfer of the developed image to the conductive receiving surface.

It is another advantage of the present invention that excessive insulating solvent liquid is avoided between the carrier web means and the conductive receiving surface so that incomplete transfer of the image is avoided, as well as the creation of a standing wave of entrapped material.

It is yet another advantage of the present invention that there is no rippling of the flexible carrier means.

It is still another advantage of the present invention that the carrier means with the master attached and the conductive receiving surface are separate and are in close proximity only at the discrete points of transfer in the transfer window to avoid excessive electrostatic force that could pull the master and the conductive receiving surface into contact.

These and other objects, features and advantages are obtained by use of a master attached to a carrier web means which transfers a developed image to a conductive receiving surface via the use of a carrier backing means and transfer roller means contactable with the carrier means to move the master adjacent to but not into contact with the conductive receiving surface to effect the electrostatic transfer of the developed image to the conductive receiving surface by having the carrier backing means maintain the carrier means and the attached master a uniform distance from the working components during charging, developing and cleaning and by having the transfer roller means traverse a distance at least equal to the length of the master.

BRIEF DESCRIPTION OF THE DRAWINGS

The objects, features and advantages of the present invention will become apparent upon consideration of the following detailed disclosure of the invention, especially when it is taken in conjunction with drawings wherein.

DETAILED DESCRIPTION OF THE PREFERRED EMBODIMENT

Figure 1:
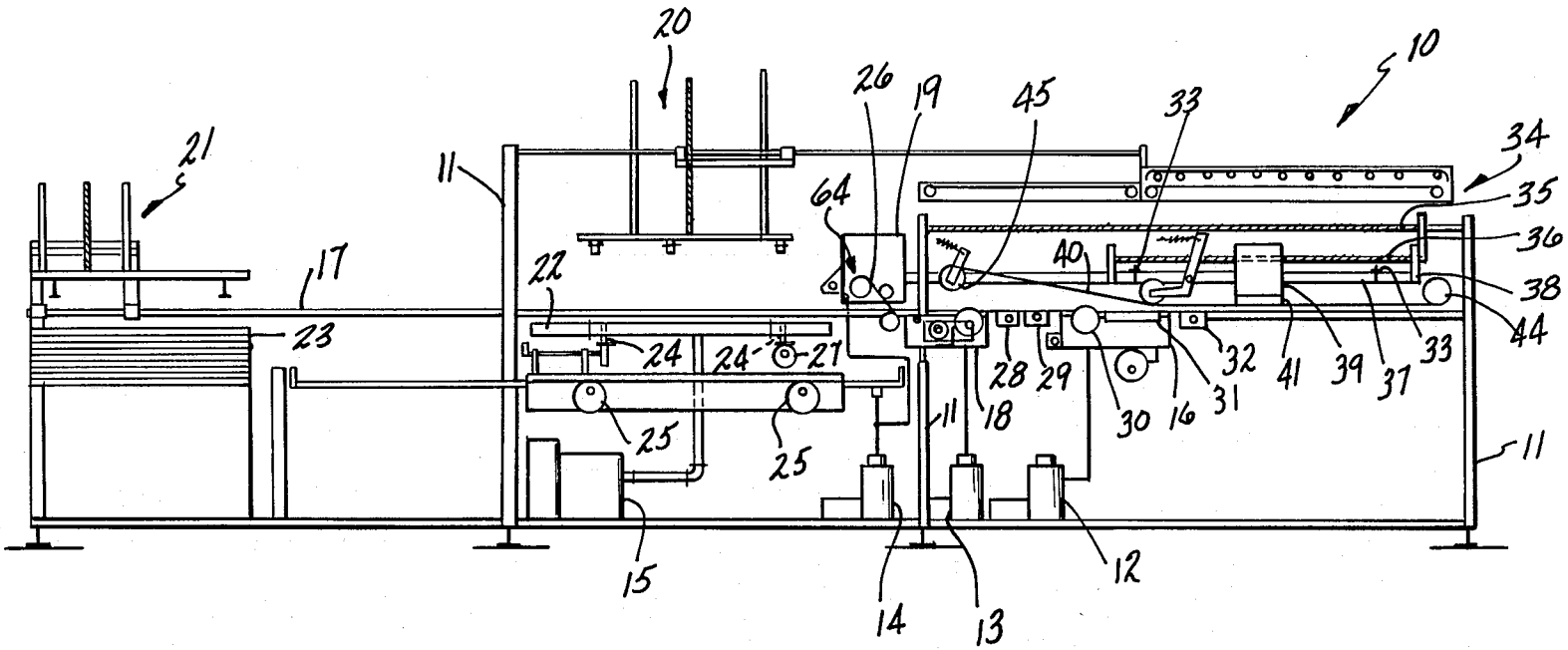
FIG. 1 is a side elevational diagrammatic illustration of the apparatus for transferring the electrostatically developed image from a master to a conductive receiving surface.

FIG. 1 shows a side elevational diagrammatic illustration of the electrostatic imaging apparatus, indicated generally by the numeral 10. Apparatus 10 has a support frame 11, to which are mounted toner tank assembly 12, cleaning station tank and feed line assembly 13, non-polar insulating solvent tank assembly 14, and vacuum pump assembly 15. Each of the tank assemblies 12, 13 and 14 have appropriate hoses and pumps to either distribute the toner to the toning or development station 16 or the non-polar insulating solvent to the master cleaning station 18 and wicking station 19, respectively. Apparatus 10 at the infeed end has a board feeder unit 21 which picks up individual conductive receiving surfaces 23, such as copper boards, by appropriate means, such as suction or vacuum pickup, and transports it along guide rails 17 to a board receiving station or stationary platen 22, where it is correctly positioned by alignment pins 24. After image transfer to the conductive receiving surface 23 has been completed, a board pickup unit 20 removes the imaged receiving surface 23 from the platen 22 in preparation for receipt of the next receiving surface 23 for imaging.

A permanent master is used to produce the desired image on each copper board or receiving surface 23. The permanent master is a multiple layered structure having a base layer of a suitable flexible and non-conductive plastic, such as a polyethylene terephthalate sold under the tradename Mylare®, which is coated with an aluminum layer and a layer of photosensitive material, such as dry film or liquid photoresist. The permanent master is produced by exposing the desired pattern, such as through a mask, to actinic radiation. The exposed pattern on the electrostatically imageable surface of the master, once thus cross-linked, creates a permanent latent image with permanently increased electrical resistivity. This latent image will hold an electrostatic charge when exposed to a charging apparatus, such as corona 32. The charged latent image attracts the toner particles of an appropriate toner when the master 48, with the image thereon, is passed through toning station 16.

Figure 2:
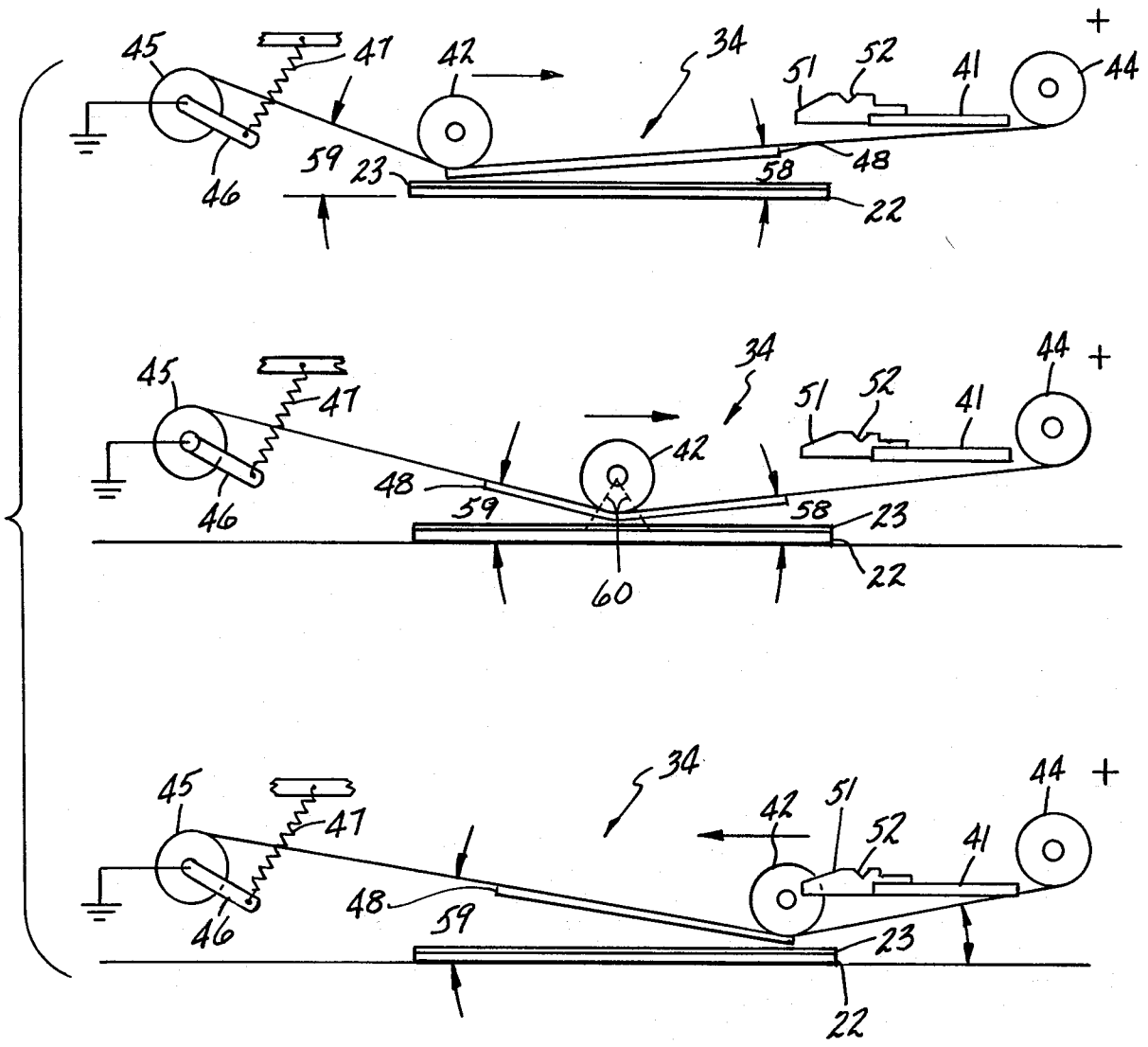
FIG. 2 is a sequential diagrammatic illustration of the transfer roler means as it traverses the carrier web means and the attached master to position the developed master adjacent to, but not in contact with, the receiving surface.
Figure 3:
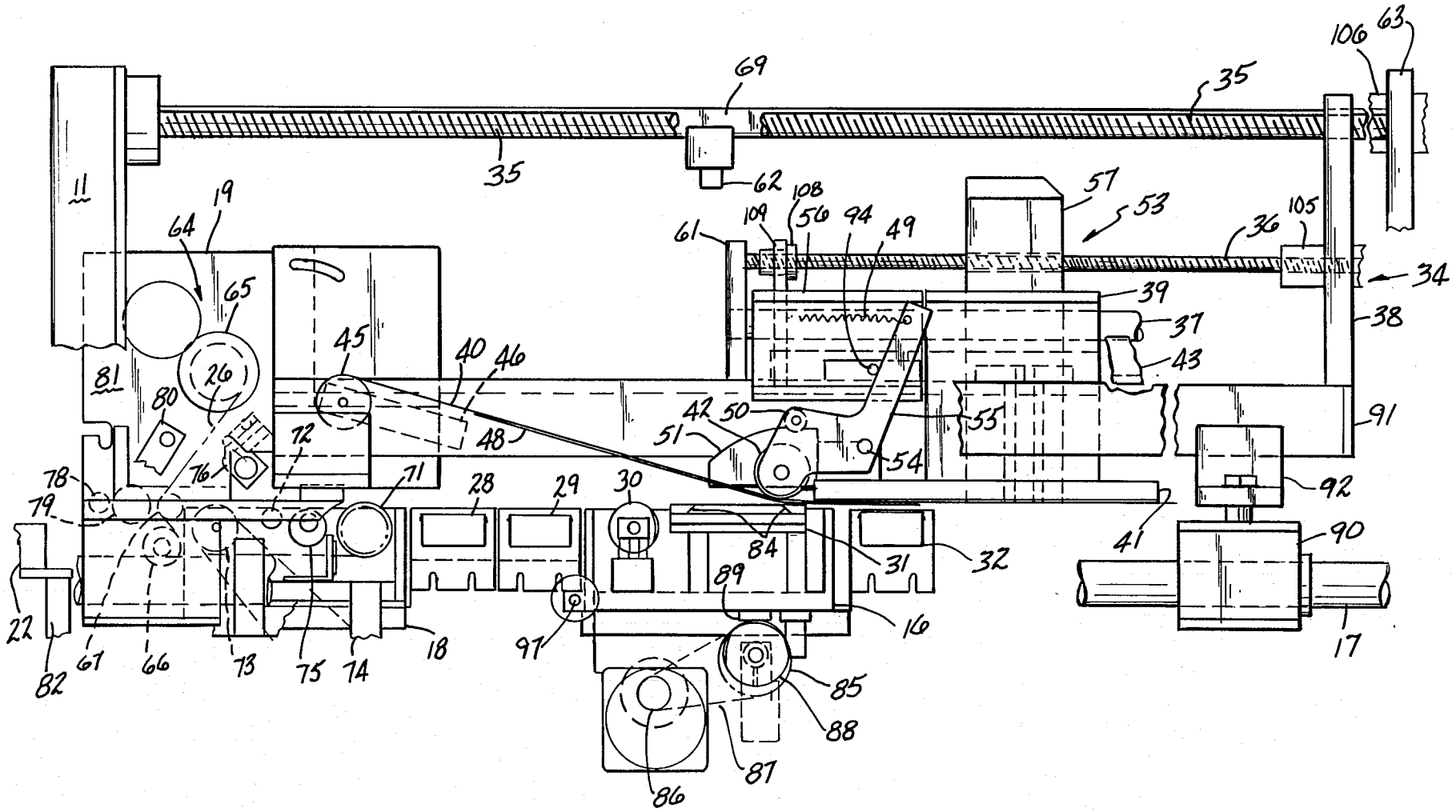
FIG. 3 is a partial side elevational view of the carrier backing means and the transfer roller means at the beginning of the development cycle.

The master, seen as 48 in FIG. 2, is placed on a stationary platen 22 of FIG. 1 prior to the picking up of any of the conductive receiving surfaces 23. Alignment pins 24 assure that the master 48 is properly positioned on the stationary platen 22 via the use of pin cams 27 and platen cams 25, or other appropriate apparatus. The master 48 is then picked up by the flexible carrier web means 40 by having the master transport assembly, indicated generally by the numeral 34, move over the platen 22, being driven along guide rails 17 by master transport assembly drive motor 106 and the main drive screw shaft 35 of FIGS. 1 and 3. The master transport assembly 34 is aligned and registered to the master 48 and platen 22 by the engagement of alignment pins 33 of FIGS. 1 and 7 on the master transport assembly 34 with the pin receptacles 104 (FIG. 7), only one of which is shown. Alignment pins 33 are raised or lowered by air cylinders 102 (only one of which is shown). As seen in FIG. 3, master transport assembly 34 travels along guide rails 17 via transport assembly bearings 90 (only one of which is shown). Bearings 90 are connected by support brackets 92 and an appropriate fastener, such as a bolt or pin, to transport assembly support members 91 (only one being shown for all of the items).

An electrical charge is supplied to the carrier web means 40, which is formed from a flexible, non-conductive material having a conductive coating. Silver coated Mylar® plastic has been successfully employed. The electrical charge is carried by the conductive coating and creates the electrostatic force which picks up and holds the master 48 on the carrier web means 40. The master transport assembly 34, with the master 48 held in place on the carrier web means 40 as seen in FIG. 2, then returns to the start position shown in FIG. 1.

A conductive receiving surface 23, such as a copper circuit board, which is preferably two-sided and is diagrammatically illustrated in FIG. 2, is placed on the platen 22 of FIG. 1 and is registered so it will be precisely aligned with the master 48 by the alignment pins 24 that are positioned by means of cams 27, or other appropriate apparatus. The position of the platen 22 can be controlled by any appropriate apparatus, such as cams 25, if necessary. Dielectric standoffs 82 (only one of which is shown in FIG. 3) can be used to electrically isolate platen 22.

Figure 4:
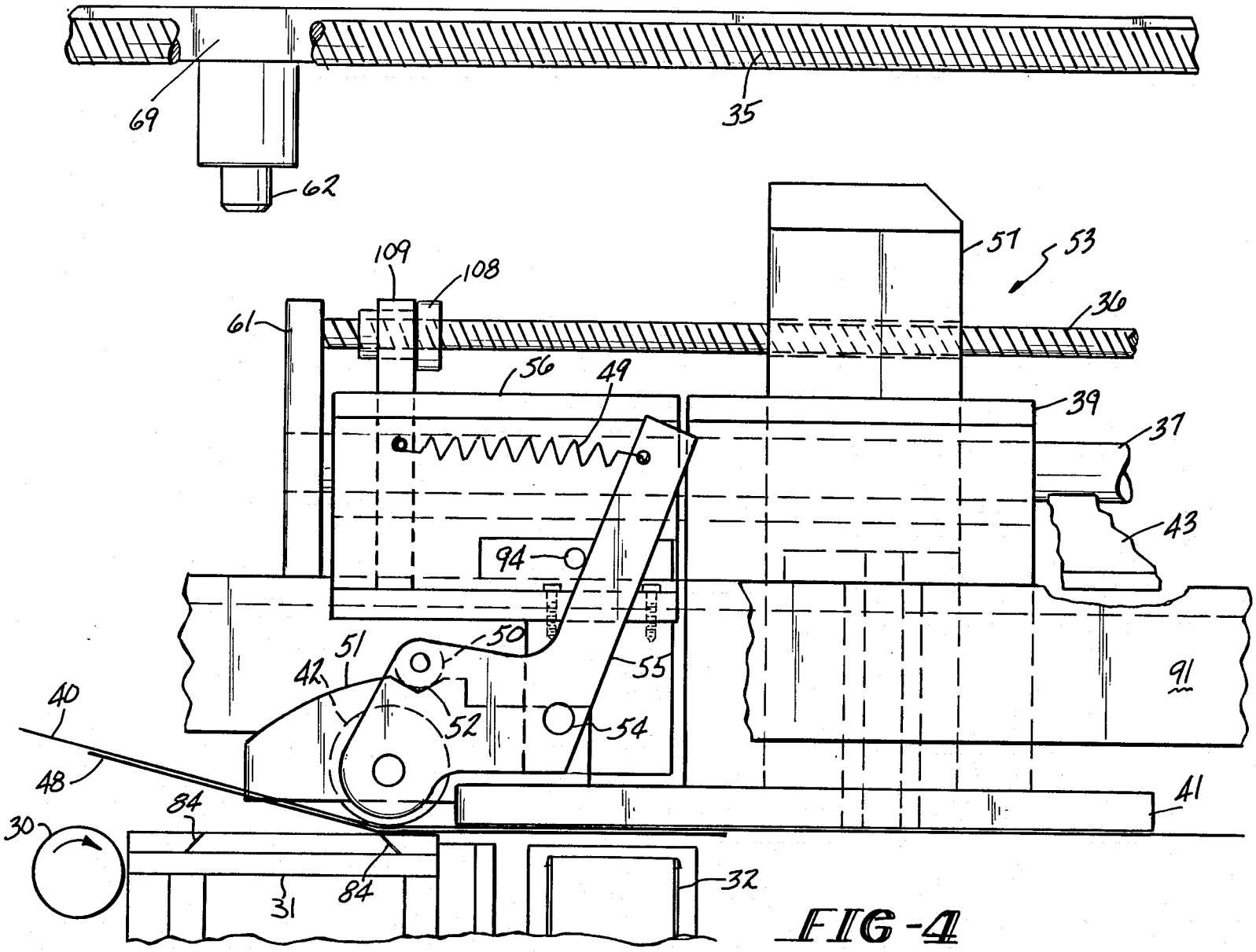
FIG. 4 is an enlarged partial side elevational view of the carrier backing means and the transfer roller means as they are positioned at the beginning of the developement cycle.
Figure 5:
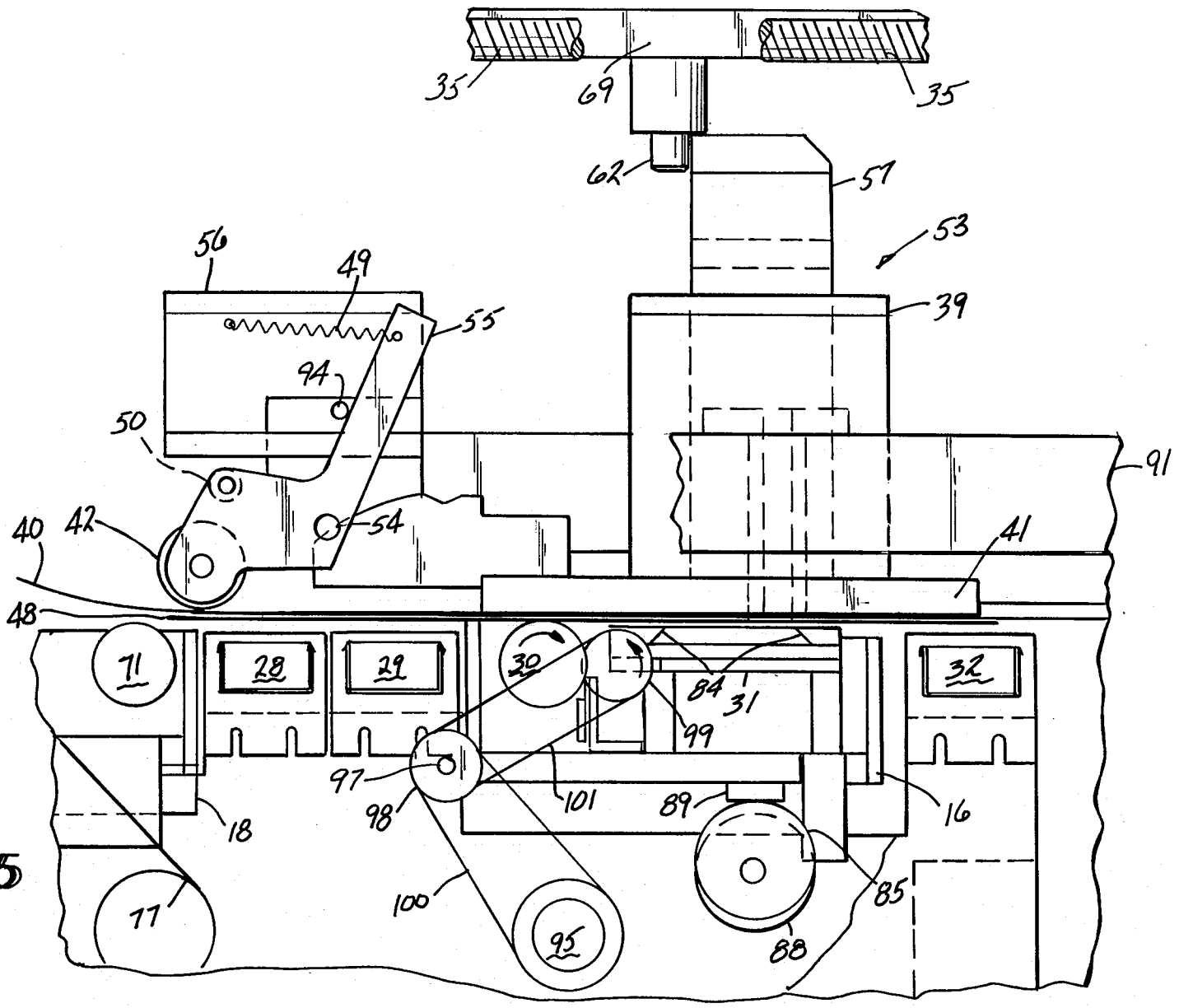
FIG. 5 is an enlarged partial side elevational view of the carrier backing means and the transfer roller means as they are positioned during the development cycle.

The master transport assembly 34, once the conductive receiving surface 23 is properly positioned on platen 22, carries the carrier web means 40 and the master 48 of FIG. 2 toward the platen 22. The master 48, as seen in FIGS. 3–5, passes over the charging corona 32, which charges the permanent latent image on the master 48, and then passes over the development or toning station 16, which includes reversing roller 30 and development toner electrode 31, to develop the latent image. Toner is fed out of the slots 84 at an angle to ensure the surface of the development electrode 31 is completely coated during development of the master 48. The toner is pumped from the toner tank assembly 12 of FIG. 1. Reversing roller 30, as seen in FIG. 5, is driven by a pair of reversing roller drive sprockets 98 and 99 that are in turn driven by a drive motor 95 and drive chains 100 and 101. Drive sprocket 99 uses a spur gear (not shown) to drive reversing roller 30.

FIGS. 3–5 show the progression of the carrier web backing means or backing plate 41 as it is driven through the development cycle. Development or toning station 16 is maintained in the raised position during this time by eccentrically shaped toning station cam 85 of FIGS. 3 and 5 being in the raised positioned shown so that the cam 55 forces up against cam receiving plate 89. Cam 85, as best seen in FIG. 3, is rotated between its off-centered raised position and its lowered position by a rotational clutch 88, drive chain 87 and cam drive sprocket 86. Once transfer roller 42 has passed over development electrode 31, depressant corona 29, and the discharge corona 28, bearing stop block 57 strikes retractable pin 62. At this time the transfer roller 42 separates from the web backing plate 41.

The separation is effected by the master transport assembly 34 being driven by the master transport assembly drive motor 106 and ts associated main drive screw shaft 35 until the stop block 57, with its bearing 39, contact retractable pin 62, which is mounted to an angle iron support rail 69. Transfer roller bearings 56 are driven by transfer roller drive screw rod 36 via drive screw 108 and its associated transfer roller drive bracket 109 until the pivot arms 55 are driven with bearings 56 into contact with stop pins 94. This causes the pivot arms 55, spring loaded by tensioning springs 49, to rotate about pins 54, thereby causing the transfer roller guide means 50 to raise up out of retention grooves 52. Carrier web backing plate 41 and its attached ramp plates 51 are held in place by the contact of stop block 57 with retractable pin 62 as master transport assembly 34 is driven by drive screw shaft 35 and its drive motor 106 toward platen 22 until the master transport assembly's stop bracket 38 contacts it. Although there are two transfer roller bearings 56, pivot arms 55, tensioning springs 49, pins 54, retention grooves 52 and ramp plates 51, only one of each are shown in the FIGURES since the FIGURES are side views.

Until this separation the transfer roller 42, with its guide roller 50, remains seated in the retention groove 52 of ramp plate 51. After separation, the transfer roller 42 is held in its raised position by being driven against contact pin 94, as seen in FIG. 4. The entire transfer roller means, indicated generally by the numeral 53 in FIGS. 3–5, is driven along bearing support shaft 37 by transfer roller drive screw rod 36. Bearing support shaft 37 is reinforced by reinforcement member 43.

The engagement of bearing stop block 57 with retractable pin 62, and the subsequent separation of the transfer roller 42 and the web backing plate 41, causes the web backing plate 41 to keep the carrier web 40 generally flat and a uniform distance from the toning station 16 during the entire development cycle. During the development cycle, excess solvent is removed from the area around the developed image by the reversing roller 30, in conjunction with the depressant corona 29. The excessive non-polar insulating solvent removed from around the developed image before transfer is directed into a collection pipe 74, which directs it to a central collection tank (not shown). Upon completion of the development cycle, retractable pin 62 is retracted upwardly to allow web backing plate 41 to continue to traverse until it is directly over cleaning station 18.

During this portion of the operation of apparatus 10, the cleaning station 18 is in a lowered position so that the cleaning roller 71 does not interfere with the master 48 as it is enroute to the transfer operation. Although not specifically shown, cleaning roller 71 is driven by drive roller 73 (FIG. 3) and drive roller 77 (FIG. 5). After the image has been transferred to the conductive receiving surface 23, the cleaning station is cammed to a raised position by cam 75 (FIG. 3) utilizing a rotational clutch (not shown).

Prior to the image transfer, wicking station 19 applies a layer of liquid containing non-polar insulating solvent to the conductive receiving surface 23 of FIG. 2. Gap spacing and charging strips 26 of FIGS. 1 and 3, preferably about 5 mils thick and formed of Mylar® plastic coated with aluminum on the bottom surface, are placed along opposing sides of the conductive receiving surface 23 by dispensing apparatus 64 as the master transport assembly 34 passes over the conductive receiving surface 23 on the platen 22. The gap spacing and charging strips 26 are played out along the two opposing side edges of the conductive receiving surface 23, as is best seen in FIG. 3, by a gap spacing strip tensioning spool 65, a strip dispensing roller 66 and a guide and tensioning roller 67. As the gap spacing strips 26 are fed out, non-polar insulating solvent is applied to the conductive receiving surface 23 (not shown) by spray bar 78. Roller 79 spreads out the solvent to ensure that a uniform layer is applied to the conductive receiving surface 23. Pivotable roller bracket arm 80, mounted to the wicking station side sheet 81, controls the positioning of roller 79. An air knife 76 can also be utilized after image transfer to remove the excess solvent on the conductive receiving surface 23.

The master transport assembly 34 of FIG. 2 stops when the master 48 on the carrier web means 40 is positioned precisely over the conductive receiving surface 23 on the platen 22, so that the master 48 precisely overlies the conductive receiving surface 23. The transfer roller 42 is then lowered into position, shown in FIG. 6 and in dotted lines in FIG. 7, so it is ready to perform the transfer operation, which is diagrammatically illustrated in FIG. 2.

As best seen in the diagrammatic illustration in FIG. 2, the master transport assembly 34 has electrically grounded web tensioning roller means 45 mounted on an idler arm 46 that is movable by means of the spring 47 to cause the roller means 45 to turn about a suitable support, such as a bearing (not shown), to maintain the proper tension on the carrier web means 40. Once properly positioned, the transfer roller 42 contacts the back or upper side of the carrier web means 40 and traverses a distance equal to at least the length of the master 48 to bring the master adjacent to, but not in contact with, the conductive receiving surface 23 at discrete points along the entire length of the master.

Figure 6:
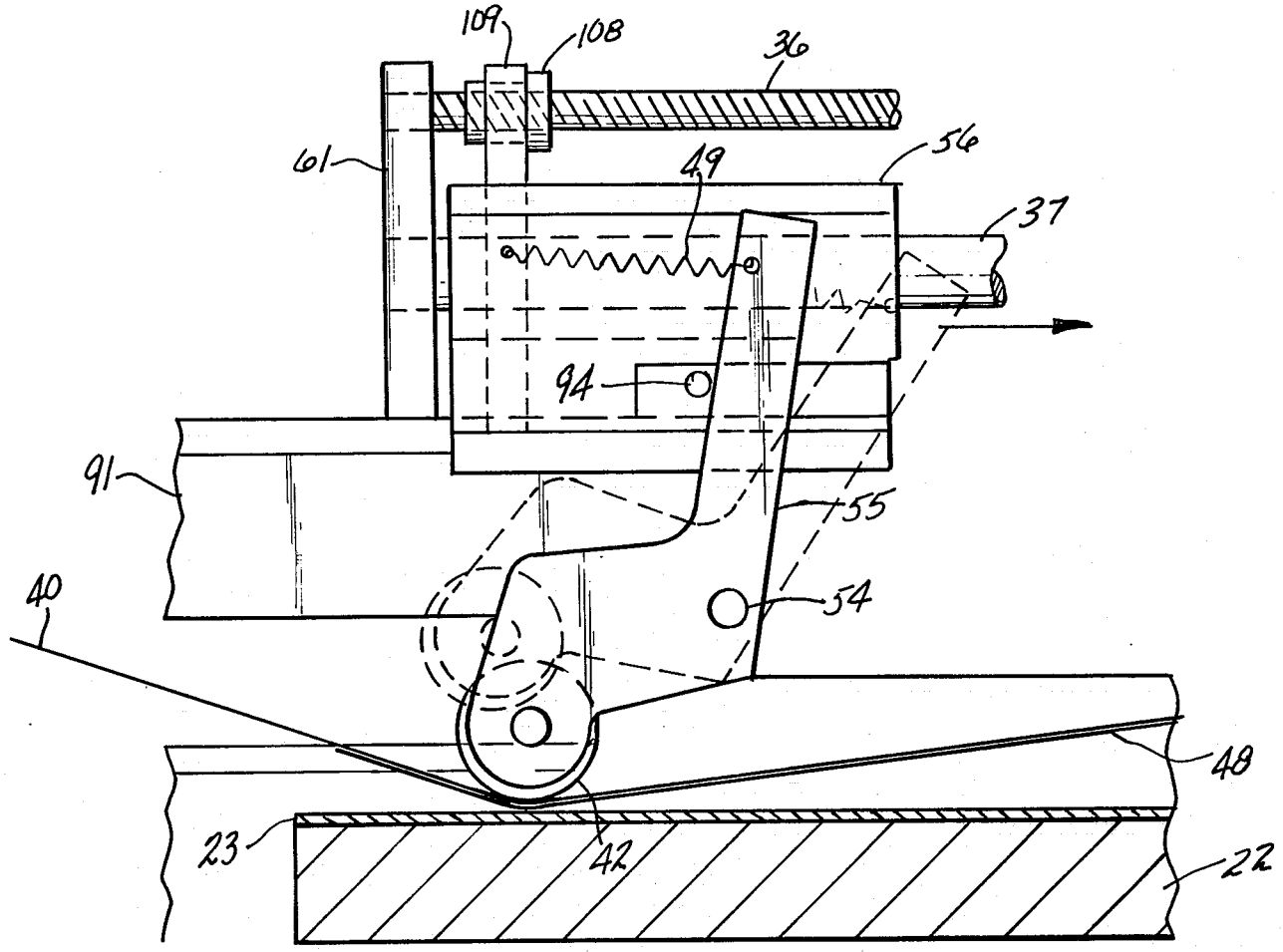
FIG. 6 is an enlarged partial side elevational view of the transfer roller in its lowered position in solid lines as it would be positioned during the transfer cycle and of the pivot arm in the raised carrying position in phantom lines as it would be just prior to the star the transfer cycle.
Figure 7:
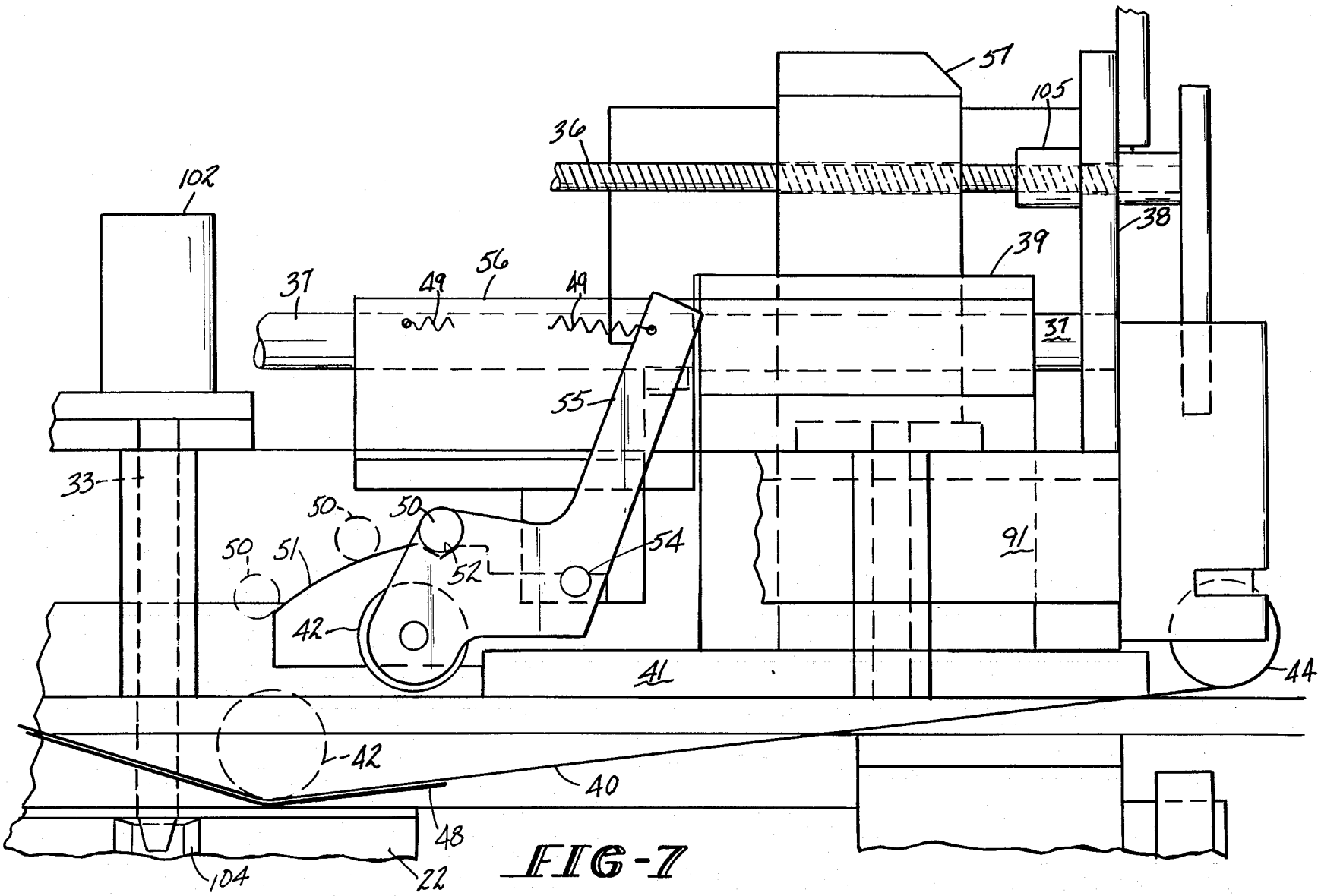
FIG. 7 is an enlarged partial side elevational view of the transfer roller means riding up into the carrier backing means at the end of the transfer cycle.

FIGS. 6 and 7 show the position of the transfer roller 42 during the transfer operation in contact with the carrier web means 40. FIG. 6 shows the apparatus at the beginning of the transfer cycle with the transfer roller 42 in its lowered position. The dotted line representation in FIG. 6 shows the position of the pivot arm 55 when the transfer roller 42 is in the raised position during the development. FIG. 7 also shows how the transfer roller guide means 50 rides up the ramp plate 51 into the retention groove 52 at the end of the transfer operation.

Web retention roller means 44 of FIG. 2 applies the high voltage charge, varying from about 200 to about 3,000 volts, dependent upon the master, to the silver surface of the carrier web means 40 to pick up and retain the master 48 on the carrier web means 40. Web retention roller means 44 combines with the tensioning roller means 45 and the transfer roller 42 to permit the transfer roller 42 to smooth out the carrier web means 40 and the master 48 to obtain a smooth, continuous surface that is free of ripples.

As is best seen in FIG. 2, the transfer roller 42 establishes with the carrier web means 40 a leading angle 58 and trailing angle 59. These leading and trailing angles 58 and 59 vary as the transfer roller traverses the entire length of the master 48. The leading angle 58 and the trailing angle 59 will vary in angulation depending upon the diameter of the transfer roller, the speed of travel of the transfer roller across the carrier web means 40, the length of the master 48, the size of the transfer gap between the master 48 and the conductive receiving surface 23, and the type of toner used. The leading angle 58 can vary from between about 1° to about 10° from the front at the beginning of contact with the master 48 to about 6° to about 30° at the end of the master 48. Similarly, the trailing angle 59 can vary from between about 45° down to about 22½° at the beginning of contact with the master 48 to about 22½° to about 10° at the end of the master 48. For example, with a 1½ inch diameter transfer roller, a 24 inch long master, a transfer roller traversing speed of about 10 inches per second and about a 5 mil thick transfer gap, the leading angle 58 was about 1° at the beginning of contact with the master 48 and about 6° at the end of the master 48. The trailing angle 59 at these two locations varied between about 22½° to about 12°. As a general guide, it is not desireable to use a larger than necessary angle for the leading and trailing angles 58 and 59.

The transfer roller 42, with the web tensioning roller means 45 and the web retention roller means 44, maintain a uniform tension on the carrier web means 40 to ensure discrete point to point transfer of the developed image on the master to the conductive receiving surface through the transfer window 60 and to avoid entrapping air and excessive non-polar insulating liquid solvent between the two surfaces. The transfer window 60 is that area on the master 48 which the diameter of the transfer roller brings into transfer proximity for discrete point transfer with the conductive receiving surface 23.

The finite gap between the two surfaces is filled with the non-polar insulating solvent across which the toner particles travel as described in copending application Ser. No. 883,797 filed July 9, 1986, now abandoned, and assigned to the assignee of the present invention, herein specifically incorporated by reference in pertinent part.

The electrostatic field between the master 48 and the conductive receiving surface 23 is established by the application of a charge on the conductive receiving surface 23. This charge is supplied by an independent high voltage source (not shown) through the aluminum coating on the gap spacing and charging strips 26 of FIG. 1. This electrostatic field permits the transfer of the developed image on the master 48 to the conductive receiving surface 23.

In operation, a master 48 is placed on the platen 22 and registered. The permanent master 48 has previously had its photosensitive surface exposed to obtain the difference in electrical resistivity required for the process by the cross-linking of the exposed surface area to obtain the permanent latent image desired. This cross-linked exposed surface area has increased electrical resistivity. The master transport assembly 34 positions the carrier web 40 over the master 48 and the carrier web 40 is registered to the platen 22 and the master 48, with the use of platen pins 24 and alignment pins 33. An electrical charge is applied to the conductive surface of the flexible carrier web 40 to pick up and hold the master 48 in the registered position on the web 40. The master transport assembly 34 then returns the carrier web 40 and the master 48 to the right-most position of FIGS. 1 and 3 on support frame 11.

The board or conductive receiving surface feed unit 21 then picks up a receiving surface 23 and places it on the platen 22 where it is registered in position via platen pins 24. Once properly positioned the master transport assembly 34 begins its traverse along guide rails 17 with the master 48, bringing the master 48 over the charge corona 32 to have the master 48 charged. The master 48 and the carrier web 40 continue traversing to bring the master 48 over the development station 16, with its development electrode 31. The master 48 remains positioned over the development electrode 31 as the transfer roller means 53 has transfer roller 42 separate from the retention groove 52 at the top of ramp plate 51 after stop block 57 contacts retractable pin 62. The master transport assembly 34 continues to transport the master 48 over the reversing roller 30 and depressant corona 29.

In detail, the separation occurs by transfer roller means 52 traversing bearing support shaft 37 until bearing 56 abuts stop plate 61. The guide roller 50 is raised out of the retention groove 52 by pivot arm 55 striking contact pin 94 of FIGS. 3 and 4, causing pivot arm 55 to rotate about pin 54. This separates the transfer roller 42 from the ramp plate 51 and the web backing plate 41 to which ramp plate 51 is attached. The disengagement of the transfer roller 42 from the retention groove 52 allows the web backing plate 41 to be driven in the opposite direction against stop bracket 38. This is accomplished by actuating the retractable stop pin 62, mounted to the support frame 11, in front of stop block 57 as the master transport assembly 34 is driven towards the platen 22 of FIG. 1 by the main drive screw shaft 35. After the web backing plate 41 abuts stop bracket 38, the retractable stop pin 62 is retracted to a raised position and the rotational clutch 88 of FIG. 3 is disengaged and permits the toning station 16 to pivot downwardly about shaft 97 to a lowered position (not shown). The web backing plate 41 is now in the transfer position. The transfer roller 42 is then in position to traverse the carrier web means 40 to effect the electrostatic transfer from the master 48 to the conductive receiving surface 23.

The conductive receiving surface 23 is wicked by wicking station 19, applying non-polar insulating solvent to it from spray bar 78, as the gap spacing strips 26 are fed out along its opposing edges. A charge is then applied to the conductive receiving surface 23, and the developed image on the permanent master 48 and the receiving surface are then ready for image transfer utilizing the transfer roller 42.

The transfer roller 42 traverses the entire length of the master 48 by being driven along bearing support shaft 37 of FIG. 3 by a drive motor 105, turning transfer roller drive screw rod 36, which drives screw 108 and its associated transfer roller drive bracket 109. Once the transfer roller 42 has traversed this entire length, as is illustratively shown in FIG. 2, its guide roller 50 rides up the ramp plate 51 of FIGS. 3 and 7 into the retention groove 52 as the bearing stop block 39 engages the stop bracket 38. The ramp plate 51 is suitably connected to carrier backing means or web backing plate 41. This positioning of the guide roller 50 continues until the entire master transport assembly 34 is moved back to the start position seen in FIG. 1. The riding of the guide roller 50 up the ramp plate 51, as best seen in FIG. 7, causes the pivot arm 55, connected to bearing 56 of FIGS. 3 ∝ 7, to pivot about pin 54 to raise the transfer roller 42 up and allow the carrier web means 40 to be flat against the web backing plate 41. This flat positioning against the backing plate 41 is best seen in FIGS. 3, 4 and 5.

Once the transfer operation has been completed the master cleaning station 18 of FIG. 3 is cammed up to its raised position by the aforementioned cam drive 75 to permit the master 48 to be cleaned prior to the next image transfer. Cleaning station 18 is then raised against carrier web 40, which is in contact with web backing plate 41. Cleaning station 18 employs a cleaning roller 71 and a spray bar 72 to apply a coating of solvent to the master 48 and then remove any excess. A web wiper (not shown) may also be used to clean the master 48 as part of the cleaning station 18 after image transfer has occurred.

Web backing plate 41 and the carried transfer roller 42 are held over the cleaning station 18 during the entire cleaning cycle by the drive motor 105 turning transfer roller drive screw rod 36 to drive the transfer roller 42 and the drive web backing plate 41 towards stop plate 61 as master transport assembly 34 is driven at the same speed in the opposite direction to its starting position against master transport assembly stop plate 63. The master 48 is discharged by discharge corona 28 prior to the master transport assembly 34 returning to its starting position. The imaged receiving surface 23 is then removed by pickup apparatus 20 and platen 22 is ready for receipt of another receiving surface 23 from feeder unit 21.

The positioning of the carrier web means 40, with the master 48 attached, flat against the web backing plate 41 permits several critical tasks to be accomplished. During passage of the carrier web means 40 over the charge corona 32, the rigid backing of the web backing plate 41 establishes a uniform distance which, in turn, ensures that a uniform charge is applied to the master surface, as can be seen in FIGS. 3–5. During development of the master 48, as seen in FIGS. 4 and 5, the flat surface provided by the web backing plate 41 continues to provide that uniform distance of the master 48 from the development electrode 31 necessary to achieve uniform development of the permanent latent image on the master 48. The accurate gap between the reversing roller 30 and the master 48 minimizes the buildup of excess insulating solvent on the master 48. It also helps prevent voids in the transferred image and reduces background in the transferred image. During the cleaning of the master, the web backing plate 41 provides the flat surface and backing to the flexible carrier web means 40 to ensure that any residual toner is removed from the master 48 by the wiper blade and cleaning roller 71 in the cleaning station 18, as well as providing the uniform distance between the master 48 and the discharge corona 28.

The use of the term permanent latent image with respect to the master 48 is intended to connote that the image is durable, lasting over a long period of time, as well as not changing in the high quality and resolution of its transferred image. For example, the permanent latent image can last months and, perhaps, years once exposed into the electrostatically imageable surface of the master 40, under proper storage conditions. Additionally, as many as 5,000 images have been transferred from a single master.

While the preferred structure in which the principles of the present invention have been incorporated is shown and described above, it is to be understood that the invention is not to be limited to the particular details thus presented but, in fact, widely different means may be employed in the practice of the broader aspects of this invention. For example, the master or the electrostatically developable surface can also include zinc oxide, cadmium sulfide, selenium or suitable organic photoconductors. The carrier web could also be made from a flexible photoconductor or the photosensitive material used as the master with the permanent latent image could be included in the carrier web. The scope of the appended claims is intended to encompass all obvious changes in the details, materials and arrangements of parts that will occur to one of ordinary skill in the art upon a reading of this disclosure.

What is claimed is:

1. Apparatus for the electrostatic transfer of a developed image from an electrostatically developable surface to a receiving surface and having charging means, developing means and cleaning means, the improvement comprising in combination:

(a) flexible carrier means movably connected to the apparatus and held in tension thereon having a first generally planar surface, and an opposing second generally planar surface, the flexible carrier means supporting the electrostatically developable surface on the first generally planar surface;

(b) transfer means reversibly movably connected to the apparatus and contactable with the second generally planar surface of the flexible carrier means to move the electrostatically developable surface adjacent to, but not in contact with the receiving surface to effect the electrostatic transfer of a developed image; and (c) backing means reversibly movably connected to the apparatus for backing and supporting at least a portion of the flexible carrier means, the backing means being positioned above the flexible carrier means and contactable with the second generally planar surface thereof and further being cooperative with the transfer means to ensure uniform spacing of the flexible carrier means from the charging means and developing means.

2. The apparatus according to claim 1 wherein the backing means further contacts the second generally planar surface of the flexible carrier means during cleaning of the electrostatically developable surface to ensure uniform spacing of the flexible carrier means from the cleaning means.

3. The apparatus according to claim 2 wherein the backing means remains positioned over the cleaning means during cleaning by moving it at the same speed, but in the opposite direction as the flexible carrier means to permit the cleaning means to contact the electrostatically developable surface at a uniform distance.

4. Apparatus for the electrostatic transfer of a developed image from an electrostatically developable surface across a liquid-filled gap to a receiving surface and having charging means, developing means and cleaning means, comprising in combination:

(a) a support frame supporting the charging means, developing means and cleaning means;

(b) supporting means for supporting the receiving surface connected to the support frame;

(c) flexible carrier means connected to the frame and held in tension thereon having a top surface and a bottom surface for supporting the electrostatically developable surface;

(d) an electrostatically developable surface supported by the flexible carrier means;

(e) positioning means connected to the frame for positioning the flexible carrier means relative to the supporting means to permit the electrostatic transfer to occur;

(f) transfer means movably connected to the support frame and contactable with the flexible carrier means to move the electrostatically developable surface adjacent to, but not in contact with the receiving surface to effect the electrostatic transfer of the developed image, the transfer means being reversible and tranversing the carrier means a distance equal to at least the length of the electrostatically developable surface;

(g) backing means movably connected to the support frame for backing and supporting at least a portion of the flexible carrier means, the backing means being positioned above the flexible carrier means and contactable therewith and further being cooperative with the transfer means to ensure uniform spacing of the flexible carrier means form the charging means and developing means, and (h) drive means for moving the transfer means and the backing means along the support frame.

5. The apparatus according to claim 4 wherein the receiving surface is conductive.

6. The apparatus according to claim 4 wherein the backing means is reversible in its travel as it traverses the distance at least equal to the length of the electrostatically developable surface.

7. The apparatus according to claim 6 wherein the electrostatically developable surface is electrostatically attracted to and held in place on the flexible carrier means.

8. The apparatus according to claim 7 wherein the electrostatically developable surface is held in place on the bottom surface of the flexible carrier means.

9. The apparatus according to claim 8, wherein the backing means contacts the top surface of the flexible carrier means with a contact surface.

10. The apparatus according to claim 9 wherein the contact surface is generally planar and elongate.

11. The apparatus according to claim 10 wherein the backing means supports the transfer means in a raised position so that the transfer means is out of contact with the flexible carrier means during a least a portion of its reversible traversing of the flexible carrier means.

12. The apparatus according to claim 11 wherein the transfer means and backing means traverse in a first direction during charging and development of the electrostatically developable surface and in a reversed second direction during image transfer.

13. The apparatus according to claim 12 wherein the backing means is in contact with the flexible carrier means during traverse in the first direction during charging and development.

14. The apparatus according to claim 13 wherein the transfer means is in the raised position during traverse in the first direction during charging and development.

15. The apparatus according to claim 14 wherein the backing means has a ramp portion with a retention groove therein, the retention groove holding the transfer means in the raised position during at least a portion of the traverse in the first direction.

16. The apparatus according to claim 15 wherein the backing means strikes a retractable stop means connected to the frame during the traverse in the first direction to release the transfer means from the retention groove and separate the transfer means from the backing means.

17. The apparatus according to claim 16 wherein the transfer means is lowered into contact with the top surface of the flexible carrier means after the transfer means is driven into contact with a stop pin in the first direction and has commenced traverse in the reversed second direction.

18. The apparatus according to claim 17 wherein the transfer means has a guide means cooperative with the ramp portion of the backing means that guides the transfer means up and into the retention groove.

19. The apparatus according to claim 18 contactable with the top surface of the flexible carrier means during its traverse in the reversed second direction during image transfer.

20. The apparatus according to claim 19 wherein the flexible carrier means is an elongate web.

21. The apparatus according to claim 19 wherein the flexible carrier means is electrically conductive on its bottom surface and is tensioned by a tensioning roller and a retention roller both movably connected to the frame on opposing sides of the transfer means, the retention means being electrically charged and the tensioning means being electrically grounded to permit the electrostatically developable surface to be electrostatically attracted to the bottom surface.

22. The apparatus according to claim 19 wherein the backing means further contacts the flexible carrier means during cleaning of the electrostatically developable surface to ensure uniform spacing of the flexible carrier means from the cleaning means.

23. The apparatus according to claim 22 wherein the backing means remains positioned over the cleaning means during cleaning by moving it at the same speed, but in the opposite direction as the flexible carrier means to permit the cleaning means to contact the electrostatically developable surface at a uniform distance.

24. Apparatus for the electrostatic transfer of a developed image from an electrostatically developable surface to a receiving surface and having charging means, developing means and cleaning means, comprising in combination:

(a) a support frame supporting the charging means, developing means and cleaning means;

(b) supporting means for supporting the receiving surface connected to the support frame;

(c) flexible carrier means connected to the frame having a top surface and a bottom surface for supporting the electrostatically developable surface;

(d) an electrostatically developable surface supported by the flexible carrier means and electrostatically attracted to and held in place on the bottom surface thereof;

(e) positioning means connected to the frame for positioning the flexible carrier means relative to the supporting means to permit the electrostatic transfer to occur;

(f) transfer means movably connected to the support frame and contactable with the flexible carrier means to move the electrostatically developable surface adjacent to, but not in contact with the receiving surface to effect the electrostatic transfer of the developed image, the transfer means being reversible and traversing the carrier means a distance equal to at least the length of the electrostatically developable surface;

(g) backing means movably connected to the support frame for backing and supporting at least a portion of the flexible carrier means, the backing means being positioned above the flexible carrier means and contactable with the top surface thereof at a generally planar and elongated contact surface and further being cooperative with the transfer means to ensure uniform spacing of the flexible carrier means from the charging means and developing means as it reversibly traverses the electrostatically developable surface, the backing means further supporting the transfer means in a raised position during at least a portion of its reversible traversing so that the transfer means is out of contact with the flexible carrier means during at least a portion of the reversible traversing.

25. The apparatus according to claim 24 wherein the receiving surface is conductive.

26. The apparatus according to claim 24 wherein the transfer means and backing means traverse in a first direction during charging and development of the electrostatically developable surface and in a reversed second direction during image transfer.

27. The apparatus according to claim 26 wherein the backing means is in contact with the flexible carrier means during traverse in the first direction during charging and development.

28. The apparatus according to claim 27 wherein the transfer means is in the raised position during traverse in the first direction during charging and development.

29. The apparatus according to claim 28 wherein the transfer means is in a lowered position contactable with the top surface of the flexible carrier means during its traverse in the reversed second direction during image transfer.

30. The apparatus according to claim 29 wherein the flexible carrier means is electrically conductive on its bottom surface and is tensioned by a tensioning roller and a retention roller both movably connected to the frame on opposing sides of the transfer means, the retention means being electrically charged and the tensioning means being electrially grounded to permit the electrostatically developable surface to be electrostatically attracted to the bottom surface.

31. The apparatus according to claim 30 wherein the backing means further contact the flexible carrier means during cleaning of the electrostatically developable surface to ensure uniform spacing of the flexible carrier means from the cleaning means.

32. The apparatus according to claim 31 wherein the flexible carrier means is an elongate web.

* * * * *

UNITED STATES PATENT AND TRADEMARK OFFICE

CERTIFICATE OF CORRECTION

PATENT NO. : 4,855,784

DATED : August 8, 1989

INVENTOR(S) : David P. Bujese

It is certified that error appears in the above—identified patent and that said Letters Patent is hereby corrected as shown below:

In Column 12, at line 1, after "18" and before "contactable", insert --wherein the transfer means is in a lowered position--.

Signed and Sealed this

Nineteenth Day of May, 1992

*Attest:*

DOUGLAS B. COMER

*Attesting Officer*

*Acting Commissioner of Patents and Trademarks*